US005507108A

United States Patent [19]

Bruggink et al.

[11] Patent Number: 5,507,108

[45] Date of Patent: Apr. 16, 1996

[54] STEAM IRON WITH SCALE PREVENTION

[75] Inventors: Wilhelmus Bruggink, Drachten; Johannes Marra, Eindhoven; Oene Van Der Wal, Drachten; Theodorus L. G. M. Thijssen, Eindhoven, all of Netherlands

[73] Assignee: U.S. Philips Corporation, New York, N.Y.

[21] Appl. No.: 192,400

[22] Filed: Feb. 4, 1994

[30] Foreign Application Priority Data

Feb. 8, 1993 [EP] European Pat. Off. ..... 93200338

[51] Int. Cl.[6] ..... D06F 75/18; C02F 5/10

[52] U.S. Cl. ..... 38/77.8; 210/282

[58] Field of Search ..... 38/77.1, 77.83, 38/75, 77.5, 77.8, 77.82, 77.6; 210/94, 282, 700; 562/24; 423/321.2

[56] References Cited

U.S. PATENT DOCUMENTS

| | | | |
|---|---|---|---|
| 3,645,682 | 2/1972 | Cochran | 423/321.2 |
| 3,923,876 | 12/1975 | Heins et al. | 562/24 |
| 4,657,672 | 4/1987 | Allen | 210/94 |
| 4,680,124 | 7/1987 | Young et al. | 210/697 |
| 4,893,422 | 1/1990 | Mahlich et al. | 210/94 X |
| 4,927,533 | 5/1990 | Takase et al. | 210/257.1 |
| 5,063,697 | 11/1991 | Valente et al. | 38/75 |
| 5,138,778 | 2/1992 | Brandolini | 38/77.5 X |
| 5,256,303 | 10/1993 | Zeiher et al. | 210/700 |

FOREIGN PATENT DOCUMENTS

| | | | |
|---|---|---|---|
| 0089256 | 9/1987 | European Pat. Off. . | |
| 2632331 | 12/1989 | France | 38/77.8 |
| 2653455 | 4/1991 | France . | |
| 3033964 | 4/1982 | Germany | 38/77.8 |
| 0037712 | 12/1991 | WIPO . | |

*Primary Examiner*—Ismael Izaguirre
*Attorney, Agent, or Firm*—Ernestine C. Bartlett

[57] ABSTRACT

A steam iron comprises a water reservoir, a steam chamber, a water-supply system for conveying water from the reservoir to the steam chamber and a metering system for injecting a phosphonate compound which acts to inhibit scale growth into the reservoir.

7 Claims, 2 Drawing Sheets

STEAM IRON WITH SCALE PREVENTION

BACKGROUND OF THE INVENTION

The invention relates to a steam iron comprising a water reservoir, a steam chamber and a water-supply system for conveying water from the reservoir to the steam chamber, said iron comprising means for reducing the deposition of scale in the water-supply system.

Such a steam iron is known per se from United States Patent Specification U.S. Pat. No. 5,063,697. Said Specification more particularly describes a steam iron comprising a detachable cartridge which contains an ion exchanger. When the iron is in operation, the water reservoir is filled with tap water which, dependent on the quality of the local tap water, is hard or not so hard. This water is conveyed from the reservoir via the cartridge to the steam chamber. By means of the ion exchanger, the tap water is (partially) softened, so that the deposition of scale (predominantly calcium carbonate) during operation of the iron is substantially reduced at the location of the water-supply system and the steam chamber. In particular the deposition of scale in the water-supply system constitutes a major problem because it may cause the conduit of the water to be vaporized to become obstructed. Obstruction of the conduit renders the steam iron unserviceable.

The drawback of the known steam iron is that the detachable cartridge containing the ion exchanger must be replaced by a "fresh" cartridge after it has been used for a number of hours. This is caused by the fact that the capacity of the customary ion exchangers to soften tap water is relatively small. Partly due to the limited volume of the water reservoir it is impossible, in practice, to provide the steam iron with a quantity of ion exchanger which is sufficient to soften the overall quantity of water used during the entire life of the device. Owing to this limitation, exchangeable cartridges containing ion exchanger are used at present. However, this solution to the problem of scale deposition in the iron is inconvenient. In addition, this solution causes constructional problems due to the exchangeability of the cartridge, which may be subject to leakage.

SUMMARY OF THE INVENTION

It is an object of the invention to obviate the above drawbacks. The invention more particularly aims at providing a steam iron having a means for reducing the deposition of scale and hence for reducing obstruction of the water-supply system. Said means for reducing the deposition of scale is to be effective throughout the life of the iron. The invention further aims at solving the problem of scale deposition in the water-supply system in a relatively cheap manner as regards the material used and the construction.

According to the invention these and other objects of the invention are achieved by a steam iron of the type described in the opening paragraph, characterized in that the agent used to reduce the deposition of scale is a phosphonate compound.

It has been found that this type of compound very effectively precludes the deposition of scale in the water-supply system. Breakdown of irons as a result of the water-supply system becoming obstructed is reduced substantially by the use of phosphonate compounds. Scale deposition does occur in the steam chamber, but the scale is very uniformly distributed over the walls of the steam chamber. Obstruction of the steam outlet ports, located in the bottom of the steam chamber, caused by scale chippings which become detached no longer occurs.

Phosphonates in very small concentrations have a scale-growth inhibiting effect in hard tap water. For example, the deposition of scale in the water-supply system of the iron is very effectively inhibited when so-called "Standard Hard Water" containing 1 ppm of a phosphonate compound is used. "Standard Hard Water" is to be understood to mean herein water having a pH-value of approximately 8, containing 4 mmol/l of $NaHCO_3$, 0.77 mmol/l of $MgSO_4$ and 2.23 mmol/l of $CaCl_2$. At concentrations below 0.2 ppm of the phosphonate compound no effective scale-growth inhibition is observed. Up to a phosphonate concentration of approximately 20 ppm, the degree of scale-growth inhibition is approximately proportional to the concentration. At higher concentrations the scale-growth inhibition increases hardly if at all. In practice it has been found that a concentration of maximally 10 ppm of phosphonate compound is more than sufficient to satisfactorily inhibit scale growth. A concentration which is optimal in practice ranges between 1 ppm and 5 ppm.

A further favourable property of phosphonates is that they generally exhibit a relatively good thermal stability in aqueous solutions. For example, these compounds do not decompose in the relevant temperature range up to 100° C. In this connection, it is noted that a scale-growth inhibitor such as polyphosphate has the disadvantage that it relatively rapidly decomposes to inactive monophosphate at a higher temperature.

A suitable embodiment of the steam iron in accordance with the invention is characterized in that the phosphonate compound used is readily soluble in water, and in that the iron comprises a metering system for introducing this phosphonate compound into the water reservoir.

A readily soluble phosphonate compound is to be understood to mean herein a compound whose solubility at room temperature in Standard Hard Water exceeds 1000 ppm. As noted above, small quantities of phosphonate suffice to obtain an active scale-growth inhibiting effect. Consequently, a small quantity of only a few ml of a concentrated solution of a readily water-soluble phosphonate compound in a separate metering system suffices to treat the overall quantity of water used throughout the life of the iron. In such an embodiment, after the water reservoir has been filled by means of a, for example mechanical, metering system, the user must add a very small quantity of phosphonate compound to the water.

Another favourable embodiment of the steam iron in accordance with the invention is characterized in that the phosphonate compound used is moderately soluble in water, and in that the iron comprises a metering system for introducing this phosphonate compound into the water reservoir.

A moderately soluble phosphonate compound is to be understood to mean herein a compound whose solubility at room temperature in Standard Hard Water ranges between approximately 30 ppm and 1000 ppm. Such a moderately soluble compound can be provided as a solid in a separate metering system. The operation of this metering system is such that prior to the first filling operation of the iron a certain quantity of water is drawn from the water reservoir. After a part of the moderately soluble phosphonate compound has dissolved in this limited quantity of water (typically a few ml), this water is metered into the water reservoir after which a fresh quantity of water is automatically drawn into the separate metering system. After a subsequent filling operation of the iron, this new quantity of phosphonate-saturated water can be metered into the fresh water to be treated. This process is repeated time after time. The volume of the separate metering system, the type of moderately soluble phosphonate compound and the volume of the water reservoir are preferably matched to each other in such a manner that after the phosphonate-saturated water is metered into the water reservoir the concentration of phosphonate compound in said water reservoir is approximately 1–5 ppm.

A further favourable embodiment of the steam iron in accordance with the invention is characterized in that the phosphonate compound is poorly soluble in water and is present in the water reservoir as a solid.

A poorly soluble phosphonate compound is to be understood to mean herein a compound whose solubility at room temperature in Standard Hard Water is less than 30 ppm. Such poorly soluble phosphonate compounds can be introduced into the water reservoir as solids, so that they directly contact the water. Due to the low solubility of these compounds in water, the maximum concentration of phosphonate compound at room temperature never exceeds maximally approximately 30 ppm. In this embodiment of the invention it is therefore not necessary to adapt the concentration of phosphonate compound in the water reservoir. Consequently, if this class of phosphonate compounds is used no separate metering system is required. Therefore, this embodiment is preferred to the above-described embodiments.

In principle, the compound can be present in the water reservoir as a coarse-grained powder in a fine-mesh envelope. The fine-mesh envelope allows, on the one hand, a satisfactory interaction between the water and the powder and, on the other hand, precludes that the powder itself can obstruct the water-supply system. Preferably, however, the phosphonate compound is provided in the reservoir in the form of a compressed pellet. In principle, a loose pellet can be provided in the reservoir, however, it is to be preferred to accommodate such a pellet in an envelope which consists either partly or completely of a fine-mesh material. In this manner, obstruction of the water-supply system is precluded if the pellet were to decompose into smaller parts after a prolonged period of time.

Very satifactory results have been obtained with a phosphonate compound which dissolves poorly in water and which corresponds to the formula $Ca_2[PO_3—C(OH)(CH_3)—PO_3]$ (dicalcium salt of 1-hydroxyethylene-(1,1 diphosphonic acid)). This phosphonate compound is poorly soluble at room temperature in Standard Hard Water, while the dissolution rate of this compound is relatively high. This relatively high dissolution rate ensures that the maximum concentration of phosphonate compound in the water reservoir is rapidly reached after a new filling operation.

BRIEF DESCRIPTION OF THE DRAWING

Aspects of the invention will be explained in greater detail by means of exemplary embodiments and the drawing, in which FIG. 1. is an embodiment of a steam iron in accordance with the invention, which comprises a metering system for a phosphonate compound.

DETAILED DESCRIPTION OF THE INVENTION

Figure 1:
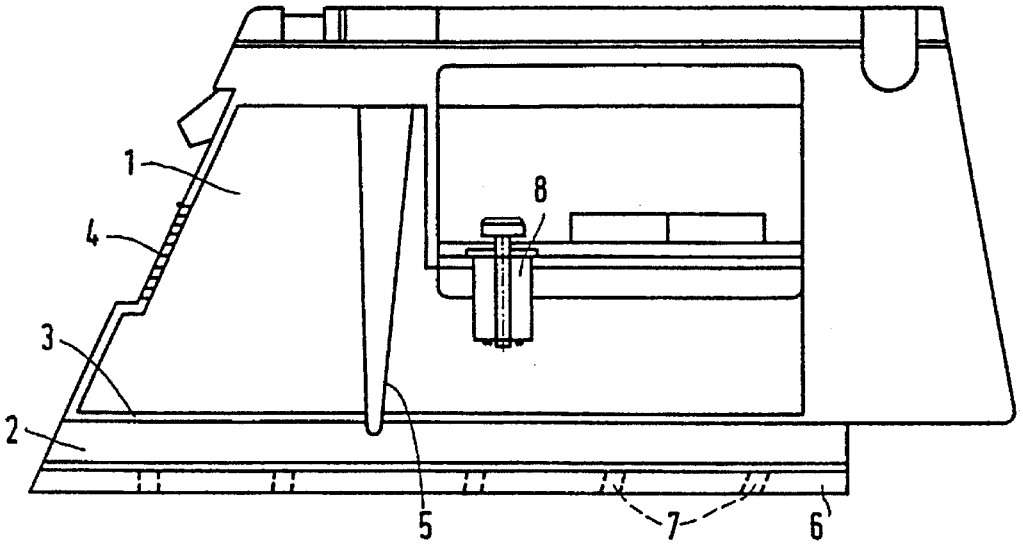

It is noted that for the sake of clarity the different components in the drawing are not necessarily drawn to the correct scale.

FIG. 1 is a diagrammatic sectional view of an embodiment of the steam iron in accordance with the invention. This steam iron comprises a water reservoir 1 and a steam chamber 2, which are separated by a partition 3. The water reservoir can be fried with hard tap water via the inlet opening 4 which can be closed. By means of the water-supply system 5 this water can be pumped from the water reservoir to the steam chamber. This water then contacts the sole plate 6 of the steam chamber which is heated by means of heating elements (not shown). The water thus introduced is vaporized on the hot sole plate, after which the steam leaves the steam iron via the steam ports 7.

The iron also comprises a metering system 8 for introducing a phosphonate compound into the water reservoir. A metering system for a readily soluble phosphonate compound is diagrammatically shown in more detail in FIG. 2-A. A metering system for a moderately soluble phosphonate compound is shown in FIG. 2-B.

Figure 2A:
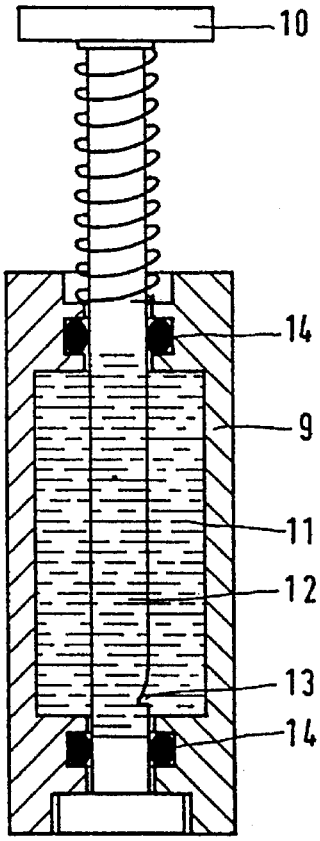
FIGS. 2A and 2B are views of two metering systems for introducing a readily soluble phosphonate compound and a moderately soluble phosphonate compound, respectively, into the water reservoir of the iron of FIG. 1.
Figure 2B:
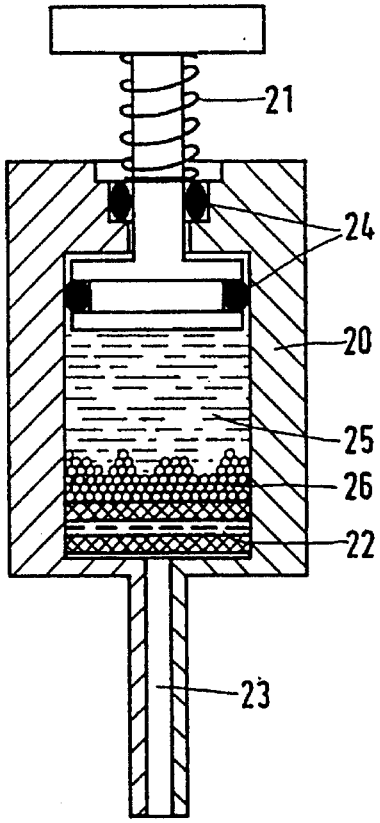

FIG. 2-A shows a system for metering a readily soluble phosphonate compound. This metering system comprises a housing 9 having a spring-mounted metering plunger 10 and a chamber 11 having a volume of approximately 4 ml. The chamber contains a concentrated solution of a phosphonate compound which can readily be dissolved in water. In the present case, the pentasodium salt of aminotrimethylene phosphonic acid was used. The plunger comprises a spindle 12 in which a groove 13 is formed. In the condition of rest the groove is present in the chamber 12. The spindle of the plunger is maintained in the housing in a leaktight manner via the robber guide rings 14.

After each filling operation of the steam iron in accordance with the present embodiment, a small volume of the phosphonate compound is metered into the water reservoir by depressing the plunger once or more than once. As a result, a small quantity of the phosphonate compound is introduced into groove 13 and passed to the water present in the reservoir. Dependent on the quantity introduced into the groove and the concentration of phosphonate, the plunger has to be depressed once or more than once. The final aim is to bring the concentration of the phosphonate compound in the water reservoir to between 1 and 5 ppm.

FIG. 2-B shows another metering system which can very suitably be used in an iron in combination with a moderately soluble phosphonate compound. This system comprises a housing 20 having a spring-mounted plunger 21, a supported filter 22 and an outlet 23. The face end portion of the outlet almost reaches the bottom of the water reservoir. Rubber rings 24 are used to preclude leakage of the system. The volume of the enclosed metering space 25 typically amounts to approximately 10 ml. The metering space is partly filled with a moderately soluble phosphonate compound 26. In the present case said compound was tri-calcium salt of aminotrimethylene phosphonic acid or penta-calcium salt of diethylene-triamine-pentamethylene phosphonic acid.

When the steam iron comprising the metering system shown in FIG. 2-B is filled for the first time, the plunger 21 is depressed and subsequently released. As the plunger returns to the condition of rest a certain quantity of water is drawn into the metering space 25. A pan of the moderately soluble phosphonate compound 26 is dissolved therein until the drawn-in water is saturated. Subsequently, this saturated water is metered into the water reservoir at the next filling operation. As the plunger returns to the condition of rest a new quantity of water is drawn into the metering system, so that this can become saturated with the moderately soluble phosphonate compound. At the next filling operation, this saturated water is metered into the fresh water to be treated.

Figure 3:
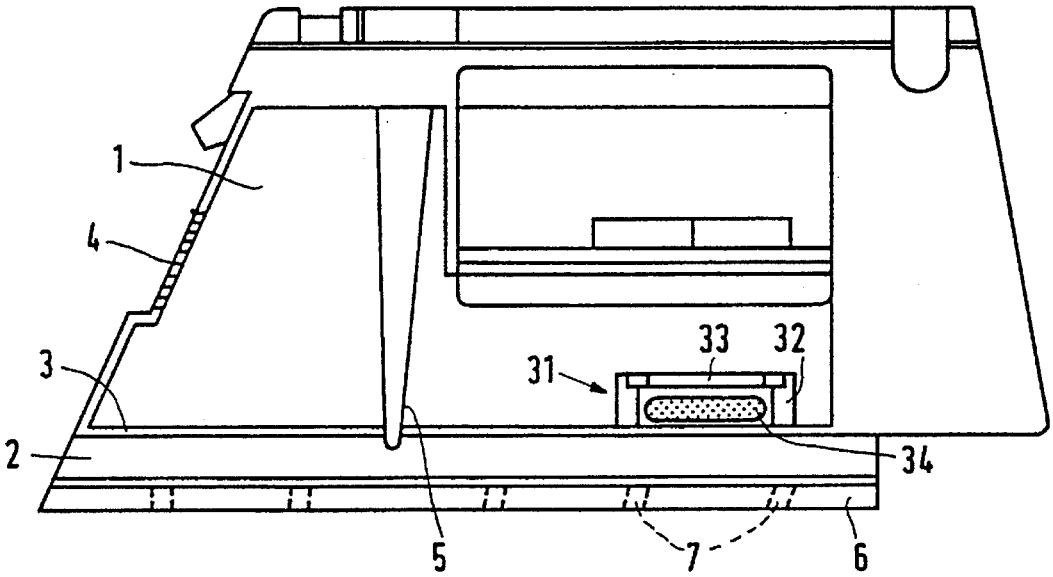
FIG. 3 is a view of another embodiment of a steam iron in accordance with the invention, which comprises an envelope which accommodates a pellet of a poorly soluble phosphonate compound.

FIG. 3 is a diagrammatic sectional view of another advantageous embodiment of the steam iron in accordance with the invention. Corresponding parts in this Figure and FIG. 1 bear the same reference numerals. In this embodiment a phosphonate compound which is poorly soluble in water is used. This compound is present in a housing 31 which is arranged at the bottom of the water reservoir. The housing comprises walls 32 of synthetic resin material (for example PMNA) and a water-permeable wall 33 in the form of a gauze of synthetic resin (for example polyester). In the present case the mesh size of the gauze was approximately 150 microns. This housing accommodates a compressed pellet 34 of a phosphonate compound which is poorly soluble in water. Satisfactory results were obtained with the dicalcium salt of 1-hydroxyethylene (1,1-diphosphonic acid. The phosphonate pellet was manufactured by axially isostatically compressing approximately 2 grams of powder of this compound into a moulded article. After filling the iron in accordance with this embodiment with water, a small portion (up to maximally 30 ppm) of the poorly soluble phosphonate can dissolve via the permeable gauze.

A number of specimen of each of the above-described three types of steam irons was subjected to a life test, together with a reference device. Said reference device was a steam iron which did not contain means for reducing the deposition of scale in the water-supply system. In these irons maximally 120 l of Standard Hard Water was vaporized.

All specimen of the three types of steam irons in accordance with the invention passed the life test. The reference device, however, became obstructed after 44 liters. Visual inspection of the steam irons in accordance with the invention showed that substantially no scale had deposited in the water-supply system of these irons, whereas the water-supply system of the reference device was completely obstructed.

We claim:

1. A steam iron comprising a water reservoir, a steam chamber and a water-supply system for conveying water from the reservoir to the steam chamber, said iron comprising means for reducing the deposition of scale in the water-supply system, characterized in that the means used to reduce the deposition of scale is a phosphonate compound.

2. A steam iron as claimed in claim 1, characterized in that the phosphonate compound used is readily soluble in water, and in that the iron comprises a metering system for introducing this phosphonate compound into the water reservoir.

3. A steam iron as claimed in claim 1, characterized in that the phosphonate compound used is moderately soluble in water, and in that the iron comprises a metering system for introducing this phosphonate compound into the water reservoir.

4. A steam iron as claimed in claim 1, characterized in that the phosphonate compound is poorly soluble in water and is present in the water reservoir as a solid mass.

5. A steam iron as claimed in claim 4 wherein the phosphonic compound is 1-hydroxyethylene (1,1-diphosphonic acid) (dicalcium salt).

6. A steam iron as claimed in claim 4, characterized in that the solid mass formed by the phosphonate compound is surrounded by a fine-mesh gauze.

7. A steam iron as claimed in claim 5 wherein the phosphonate compound is 1-hydroxyethylene (1,1-diphosphonic acid) (dicalcium salt).

* * * * *